United States Patent [19]

St. Jean

[11] 4,096,594

[45] Jun. 27, 1978

[54] MATTRESS DEVICE

[75] Inventor: Raymond A. St. Jean, West Warwick, R.I.

[73] Assignee: The Raymond Lee Organization, Inc., New York, N.Y. ; a part interest

[21] Appl. No.: 755,800

[22] Filed: Dec. 30, 1976

[51] Int. Cl.[2] ..... A61G 7/02

[52] U.S. Cl. ..... 5/90; 5/91; 4/144.1

[58] Field of Search ..... 5/90, 91, 334, 335; 4/134, 164, 185 S, 110; 297/453

[56] References Cited

U.S. PATENT DOCUMENTS

| | | | |
|---|---|---|---|
| 630,111 | 8/1899 | Roels | 5/90 |
| 909,578 | 1/1909 | Collings | 4/134 |
| 1,468,603 | 9/1923 | Mack | 5/91 |
| 1,492,798 | 5/1924 | Houston | 5/90 X |
| 1,598,359 | 8/1926 | Northrop | 5/91 |
| 2,550,293 | 4/1951 | Platis | 5/91 |
| 2,982,976 | 5/1961 | Ferolito | 5/91 |
| 3,814,030 | 6/1974 | Morgan | 297/453 UX |

*Primary Examiner*—Casmir A. Nunberg
*Attorney, Agent, or Firm*—Daniel Jay Tick

[57] ABSTRACT

A channel formed through a mattress provides a pair of spaced mattresses, which, together with the channel, form a mattress having a top and sides. A pan is removably positioned in the channel for collecting liquids. The pan is positioned at a pitch in a manner whereby liquids collected therein flow toward a predetermined point at the bottom of the pan. A hose has one end coupled to the predetermined point at the bottom of the pan for draining liquids in the pan therefrom. A mesh material covers the channel at the top of the mattress for supporting a person on the mattress over the channel and permitting liquid to flow therethrough.

2 Claims, 4 Drawing Figures

MATTRESS DEVICE

BACKGROUND OF THE INVENTION

The present invention relates to a mattress device. More particularly, the invention relates to a mattress device for preventing discomfort to a bedwetter using a mattress.

Objects of the invention are to provide a mattress device of simple structure, which is inexpensive in manufacture, used with facility and convenience, and functions efficiently, effectively and reliably to prevent discomfort to incontinent bedridden people.

BRIEF DESCRIPTION OF THE DRAWINGS

In order that the invention may be readily carried into effect, it will now be described with reference to the accompanying drawings, wherein.

DETAILED DESCRIPTION OF THE INVENTION

The mattress device of the invention is for preventing discomfort to a bedwetter or bedridden incontinent person using a mattress.

Figure 1:
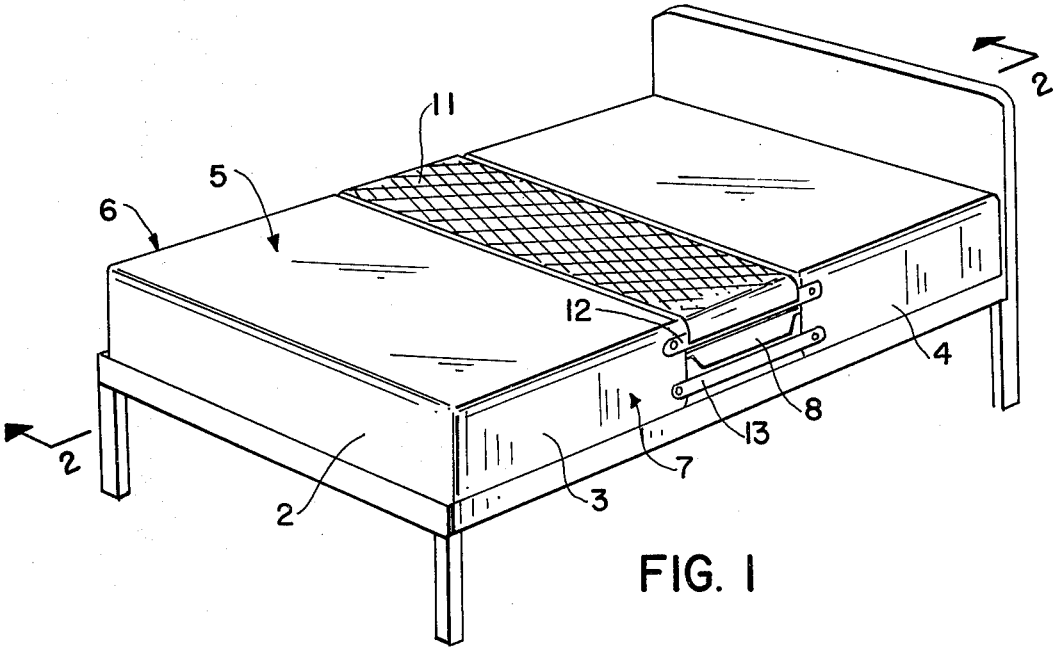
FIG. 1 is a perspective view of an embodiment of the mattress device of the invention.

The mattress device of the invention comprises a channel 1 (FIG. 2) formed through a mattress 2 to provide a pair of spaced mattresses 3 and 4, which, together with the channel, form a mattress having a top 5 (FIGS. 1 to 3) and sides 6 and 7 (FIG. 1).

Figure 2:
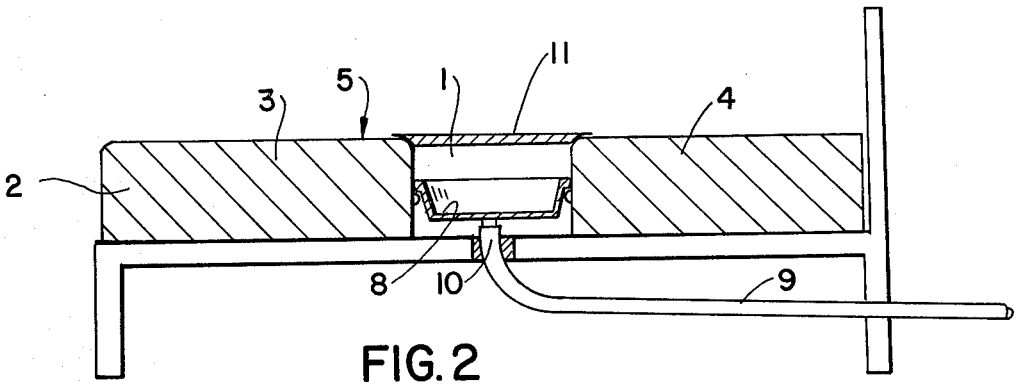
FIG. 2 is a cross-sectional view, taken along the lines II—II, of FIG. 1.
Figure 3:
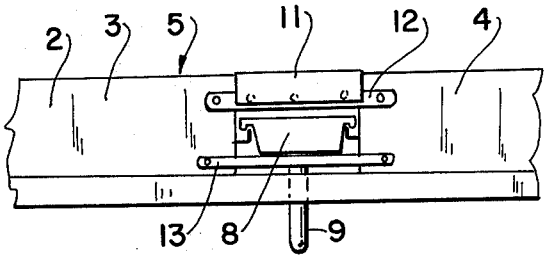
FIG. 3 is a side view of the embodiment of FIG. 1.

A pan 8 is removably positioned in the channel 1, as shown in FIGS. 1 to 3, for collecting liquids. The pan 8 is positioned at a pitch or inclination in a manner whereby liquids collected therein flow toward a predetermined point at the bottom of the pan (not shown in the FIGS.).

A hose 9 (FIGS. 2 and 3) has one end 10 coupled to the predetermined point at the bottom of the pan 8, as shown in FIG. 2, for draining liquid in the pan therefrom.

A mesh material 11 of any suitable known type, which is strong enough to support the weight of a person such as, for example, nylon mesh, covers the channel 1 at the top 5 of the mattress for supporting a person on the mattress over the channel and permitting liquid to flow therethrough. The mesh material 11 is releasably affixed over the channel 1 at the top 5 of the mattress via snap fastening devices affixed to the sides 6 and 7 of the mattress and extending across the channel. The snap fastening devices, of which one snap fastening device 12 is shown in FIGS. 1 and 3, each comprise an elongated flat member having a plurality of snap fasteners thereon in spaced relation. The mesh material 11 has corresponding cooperating parts of the snap fasteners affixed thereto so that it is fastened to the snap fastening devices via said snap fasteners.

The pair of mattresses 3 and 4 are fastened to each other with the channel 1 between them, by a pair of fastening members affixed to the sides 6 and 7 of said mattress. The fastening member 13 is shown in FIGS. 1 and 3. The fastening members are elongated flat members.

Figure 4:
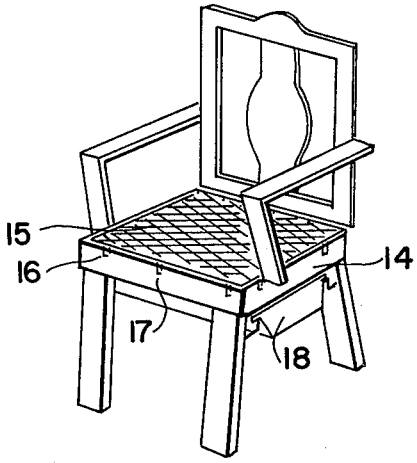
FIG. 4 is another embodiment of the invention, as applied to a chair.

FIG. 4 illustrates a chair device for preventing discomfort to an incontinent user thereof. The chair device of FIG. 4 comprises a seat frame 14 covered with mesh material 15 which is releasably affixed to said frame via snap fasteners 16, 17, and so on, affixed to said mesh material and said frame (FIG. 4). The mesh material is the same as the mesh material 11 utilized in the mattress device of the invention and supports a person seated in the chair while permitting liquid to flow therethrough.

A pan 18 is removably positioned under the seat frame 14 of the chair, as shown in FIG. 4, for collecting liquids.

The mattress device of the invention reduces or eliminates bed sores and rashes. It keeps a patient much drier than a known type of mattress. This adds to the comfort of the patient and eliminates rashes and bed sores.

While the invention has been described by means of specific examples and in specific embodiments, I do not wish to be limited thereto, for obvious modifications will occur to those skilled in the art without departing from the spirit and scope of the invention.

I claim:

1. A mattress device for preventing discomfort to a bedwetter using a mattress, said mattress device comprising a channel formed through a mattress to provide a pair of spaced mattresses, which, together with the channel, form a mattress having a top and sides;

a pan removably positioned in the channel for collecting liquids, said pan being positioned at a pitch in a manner whereby liquids collected therein flow toward a predetermined point at the bottom of the pan;

a hose having one end coupled to the predetermined point at the bottom of the pan for draining liquids in the pan therefrom;

mesh material covering the channel at the top of the mattress for supporting a person on the mattress over the channel and permitting liquid to flow therethrough; and fastening means for fastening the pair of mattresses to each other with the channel between them.

2. A mattress device as claimed in claim 1, further comprising snap fastening means affixed to the sides of the mattress and extending across the channel for releasably affixing the mesh material over the channel at the top of the mattress.

* * * * *